United States Patent [19]

Price

[11] 3,964,912

[45] June 22, 1976

[54] RUTHENIUM CONTAINING PHOTOGRAPHIC DEVELOPERS

[75] Inventor: Harry J. Price, Rochester, N.Y.

[73] Assignee: Eastman Kodak Company, Rochester, N.Y.

[22] Filed: Dec. 29, 1975

[21] Appl. No.: 645,104

Related U.S. Application Data

[63] Continuation of Ser. No. 504,596, Sept. 9, 1974, abandoned, and a continuation-in-part of Ser. No. 483,252, June 26, 1974, abandoned.

[52] U.S. Cl. ..... 96/66.3; 96/66 HD; 96/66 R

[51] Int. Cl.[2] ..... G03C 5/30

[58] Field of Search ..... 96/50, 63, 66, 66.3, 96/95

[56] References Cited

UNITED STATES PATENTS

| | | | |
|---|---|---|---|
| 3,748,138 | 7/1973 | Bissonette | 96/66.3 |
| 3,765,891 | 10/1973 | Travis | 96/55 |
| 3,862,842 | 1/1975 | Bissonette | 96/66 R |

*Primary Examiner*—Mary F. Kelley
*Attorney, Agent, or Firm*—Carl O. Thomas

[57] ABSTRACT

A composition is disclosed useful in developing silver halide photographic elements containing specifically selected developing agents for silver halide and a ruthenium(II) or ruthenium(III) cationic complex as a development accelerator. The ruthenium complex includes a predominance of amine or ammine ligands. Each of the developing agents exhibits an induction period in the absence of the ruthenium complex in excess of about 5 seconds. Polyhydroxybenzene, ascorbic acid, hydroxylamine, hydroxyurea and pyrimidine developing agents are representaive of those which are useful in the practice of my invention. A method of accelerating photographic development using the above composition is also disclosed.

24 Claims, No Drawings

RUTHENIUM CONTAINING PHOTOGRAPHIC DEVELOPERS

This is a continuation of application Ser. No. 504,596, filed Sept. 9, 1974, and a continuation-in-part of my copending patent application Ser. No. 483,252, filed June 26, 1974, now abandoned.

My invention relates to novel photographic silver halide developers. More specifically, my invention relates to compositions useful in developing silver halide photographic elements which compositions contain at least one silver halide developing agent and a development accelerator.

In have discovered quite unexpectedly that when each of the developing agents present exhibit (in the absence of any other developing agents which may be present) an induction period in excess of 5 seconds, the performance of the developer can be significantly enhanced through the incorporation of at least one ruthenium(III) or (II) cationic complex which includes a predominance of ammine or amine ligands, provided at least one of the developing agents exhibits a rate of reduction of ruthenium(III) in the ruthenium(III) cationic complex, or produced by oxidation of the ruthenium(II) cationic complex, which exceeds its rate of reduction of silver halide.

In relation to photographic developers consisting essentially of polyhydroxybenzene, ascorbic acid, hydroxylamine, hydroxyurea and/or pyrimidine developing agents, I have discovered quite surprisingly that any cationic ruthenium(III) complex incorporated or produced in situ which exhibits a ruthenium(III) reduction potential no less positive than the oxidation potential of at least one of the developing agents will function as a development accelerator.

Stated in a different way, I have discovered that the development of silver halide photographic elements can be accelerated through the incorporation of ruthenium complexes in basic aqueous photographic developers where the ruthenium complexes and developing agents are as indicated above.

Based upon my knowledge of the state of the art at the time of my discovery I consider these novel photographic silver halide developers to be surprisingly advantageous. In the November-December 1970 issue of *Photographic Science and Engineering*, Vol. 14, No. 6, I published an article titled "The Mechanism of Development by Metal Complexes". In my article I reported observations based on the use of ruthenium(II) hexammine as a developing agent—not in combination with known developing agents, but as a sole developing agent.

Bissonette, U.S. Pat. 3,748,138, issued July 24, 1973 (filed Oct. 14, 1971), commonly assigned, teaches the use of metal coordination complexes having a coordination number of 6—specifically, cobalt and chromium complexes—to be useful development accelerators either when incorporated into a silver halide emulsion or when employed in certain photographic developers. In Examples 1 through 3 Bissonette employs hydroquinone, a developing agent having an induction period in excess of 5 seconds, in combination with N-methyl-p-aminophenol sulfate, a developing agent exhibiting an induction period substantially below 5 seconds (approximately 1 second at a pH of 10). In the remaining Examples each of the developing agents exhibit an induction period of less than 5 seconds. Except for the hydroquinone developing agent of Examples 1 through 3, every developing agent named by Bissonette exhibits an induction period of well below 5 seconds and/or a reduction rate for silver halide which exceeds the rate at which it reduces ruthenium(III) cationic complexes. It is therefore apparent that Bissonette does not specifically disclose any photographic silver halide developer in which each developing agent present, in the absence of other developing agents, exhibits an induction period in excess of 5 seconds and in which at least one of the developing agents more readily reduces a ruthenium(II) cationic complex than silver halide. Further, Bissonette does not specifically mention ruthenium complexes as being useful development accelerators.

Beavers U.S. Ser. No. 398,515, filed Sept. 18, 1973, commonly assigned, which is a continuation-in-part of Beavers U.S. Ser. No. 312,159, filed Dec. 4, 1972, now abandoned, teaches the incorporation of cobalt(III) and chromium(III) ammine and amine complexes in photographic silver halide emulsions in combination with azaindene anti-foggants.

In *Research Disclosure*, Vol. 109, pp. 28–31, Item 10908, titled "Lithographic Materials Containing Metal Complexes," published May 1973, it is disclosed to incorporate cobalt(III) and chromium(III) complexes containing certain ammine and amine ligands into silver halide emulsions for the purpose of accelerating development. A hydroquinone "lith-type" developer (Developer A in Masseth U.S. Pat. 3,573,914, issued Apr. 6, 1971) is employed. Ruthenium(III) complexes are reported to have been tested under conditions similar to those employed in testing the cobalt(III) and chromium(III) complexes, but the contrasts achieved were too low for use in lithographic type photographic elements. In Beavers U.S. Ser. No. 450,263, filed Mar. 11, 1974, commonly assigned, concentrations of ruthenium cationic complexes in silver halide photographic emulsions of less than 1 gram per mole of silver are disclosed to produce unexpected advantages. In neither the Research Disclosure nor the Beavers patent application is there any teaching of incorporating the ruthenium cationic complex in a photographic developer rather than in a photographic emulsion.

The significance of the teachings cited above can be appreciated best by reviewing the development of the art. When cobalt(III) and chromium(III) amine and ammine complexes were recognized to be development accelerators, they were investigated both in photographic silver halide developers and in photographic silver halide emulsions. While both approaches were successful, it was favored to incorporate the cobalt(III) or chromium(III) complex in the photographic developer, since incorporation in photographic silver halide emulsions produced a degree of fogging, which is, of course, generally southt to be minimized in negative-working emulsions, but not fogged direct-positive emulsions.

Unfortunately, the incorporation of cobalt(III) and chromium(III) ammine and amine complexes in photographic silver halide developers was also not without secondary disadvantages. Both cobalt(III) and chromium(III) ammine and amine complexes can be readily reduced and thereby caused to release ligands so that they cease to be effective development accelerators. However, the recapture of these released ligands to regenerate the cobalt(III) or chromium(III) ammine or amine development accelerator is not readily accomplished under the normal conditions of use. Thus, photographic developers containing cobalt(III) and chromium(III) ammine and amine ligand complexes as development accelerators were found to require a significant degree of care in storage and use.

This then was the state of the art when Beavers discovered significant advantages for incorporating cobalt(III) and chromium(II) complexes in photographic silver halide emulsions in combination with azaindene anti-foggants. The combination of ruthenium(III) complexes with azaindenes at like concentrations in emulsions did not, however produce corresponding advantages. Beavers' later discovery that ruthenium complexes at concentrations below 1 gram per mole of silver could be advantageously incorporated in photographic silver halide emulsions was not known to me at the time of my invention.

In have discovered quite unexpectedly that ruthenium(II) and (III) cationic complexes having a predominance of ammine and amine ligands can be employed to reduce the induction period of certain types of developing agents having substantial induction periods—that is, in excess of about 5 seconds. I have found that induction periods can be decreased in most instances by approximately an order of magnitude. I have further observed that these ruthenium complexes in combination with such developing agents significantly increase that rate of development following the induction period—i.e., the continuation stage of development.

In have additionally observed that these ruthenium complexes offer distinct advantages over corresponding cobalt(III) and chromium(III) complexes. First, I have observed that both ruthenium(III) and ruthenium(II) complexes can be employed advantageously in the practice of my invention. Whereas the effectiveness of cobalt(III) and chromium(III) complexes is destroyed by ligand release in reduction to cobalt(II) and chromium(II) complexes, ruthenium(III) complexes do not lose ligands or effectiveness by reduction to ruthenium(II) complexes. This then overcomes one of the principal disadvangates that have been encountered in using metal complexes of this type as development accelerators in photographic silver halide developers. For reasons more fully discussed below, this also permits comparatively lower concentrations of ruthenium complexes to be employed. I have further observed combinations of ruthenium complexes and developing agents according to my invention to form more effective photographic silver halide developers than corresponding combinations including either cobalt(III) or chromium(III) complexes. I also believe that the various advantages for the use of ruthenium complexes in photographic silver halide emulsions set forth in Beavers U.S. Ser. No. 450,263, cited above, could also be achieved in the practice of my invention.

While I do not wish to be bound by any particular theory, it is my belief that ruthenium complexes function as development accelerators in the photographic silver halide developers of my invention in a manner that differs markedly from that of corresponding cobalt(III) and chromium(III) development accelerators. In considering a photographic silver halide developer containing a ruthenium complex development accelerator and a developing agent which requires a substantial induction period in the absence of the ruthenium complex and which more readily reduces ruthenium(III) than silver halide, it is my belief that the ruthenium complex forms a redox couple between the developing agent and the silver halide. That is, a continuous cycling of the ruthenium complex occurs between (1) an oxidation-reduction reaction with the developing agent in which the ruthenium is reduced from ruthenium(III) to ruthenium(II) while the developing agent is oxidized and (2) an oxidation-reduction reaction with silver halide in which the ruthenium(II) is oxidized and silver halide is reduced to metallic silver to form a silver image. In these reactions the ruthenium complex acts as a catalyst for development of silver halide and is not consumed. Thus, low concentrations of ruthenium are effective. It is also apparent that corresponding ruthenium(III) and (II) complexes can be employed interchangeably, since it is immaterial whether the ruthenium complex first oxidizes the developing agent or reduces silver halide.

These and other advantageous features of my invention will become further apparent in the following description of certain preferred embodiments.

The cationic ruthenium complexes employed in the practice of this invention comprise a divalent or trivalent ruthenium ion surrounded by certain other molecules which are referred to as ligands. The ruthenium ion is a Lewis acid; the ligands are Lewis bases. Werner complexes are well known examples of these complexes. While it is possible to form ruthenium complexes that are neutral (i.e., carry no net charge) or are negatively charged, only ruthenium complexes exhibiting a net positive charge, i.e., cationic complexes, are employed in the practice of this invention.

The cationic ruthenium complexes employed in the practice of this invention include a predominance of (that is, at least four) ammine or amine ligand coordination bonds. The amine ligands include primary, secondary and tertiary amine ligands and include diamines and heterocyclic amines. One preferred class of amine ligands are acyclic aliphatic amine ligands, such as those comprised of alkyl, alkylene and alkanol aliphatic moieties. Each aliphatic moiety preferably includes 6 or fewer carbon atoms. Alkylene diamines have been found particularly useful in forming bidentate ligands. Bidentate ligands which form with the ruthenium atom 5- to 8-membered rings have been found to produce particularly stable complexes. Typical heterocyclic amine lignads and comprised of 5- and 6-membered rings including at least one nitrogen atom with the remaining atoms being entirely carbon atoms or including at most one other hetero atom, such as nitrogen, oxygen, or sulfur. Exemplary preferred ammine and amine ligand-forming compounds include ammonia, ethylene diamine, trimethylene diamine, diethanol amine, dipropanol amine, diethylene triamine, alkyltetramines, pyridine, morpholine, pyrrole, pyrazole, pyrazine, pyrazoline, oxazole, thiazole, etc.

A minor proportion of the coordination bonds making up the cationic ruthenium complex can be provided by ligands other than ammine or amine ligands. A ruthenium(II) or (III) complex can contain 1 or 2 monodentate ligands, such as water, halogen, thiocyanate, etc., or a single bidentate ligand.

There will, of course, be anions associated with the foregoing complex cations. Any anion which does not exert undesirable effects upon the photographic element being processed may be employed. Typical useful anions include chloride, bromide, sulfite, sulfate, perchlorate, nitrite, nitrate, tetrabromozincate, tetrafluoroborate, hexafluorophosphate, thiocyanate, dithionate, methyl sulfonate, tolyl sulfonate, and the like.

While a variety of ruthenium(II) and (III) complexes can be employed in the practice of my invention, for any specific application the choice of a ruthenium complex must be considered in conjunction with the choice of developing agent. To assure that at least one developing agent exhibits a rate of reduction of the ruthenium(III) complex in the photographic silver halide developer which exceeds the rate at which it directly reduces silver halide in the absence of the ruthenium(III) complex, the ruthenium(III) complex is chosen to have a reduction potential which at least equals or is more positive than the oxidation potential of the developing agent. In a preferred form of the invention the ruthenium(III) complex present in the photographic silver halide developer exhibits a reduction potential which is intermediate between the oxidation potential of the developing agent and the reduction potential of the silver halide being developed. For example, where hydroquinone is being employed as the developing agent for silver bromide, the ruthenium(III) complex preferably exhibits a reduction potential between 0.10 volt, the oxidation potential of hydroquinone, and 0.70 volt, the reduction potential of silver bromide.

Exemplary of ruthenium(II) and (III) complexes useful in the practice of this invention are those set forth below in Table I. The reduction potentials of the ruthenium(III) complexes are measured by the procedures set forth by Lim, Barclay and Anson, *Inorganic Chemistry*, Vol. 11, No. 7, "Formal Potentials and Cyclic Voltammetry of Some Ruthenium-Ammine Complexes", 1972. It can be seen that the selection of the anion associated with the complex does not affect its reduction potential.

TABLE I

| | Exemplary Cationic Ruthenium Complexes | Reduction Potentials (volts)for Ruthenium-(III)Complexes |
|---|---|---|
| RU- 1a | hexammine ruthenium(III) chloride | +0.10[a] |
| RU- 1b | hexammine ruthenium(II) chloride | |
| RU- 2a | hexammine ruthenium(III) bromide | +0.10[a] |
| RU- 2b | hexammine ruthenium(II) bromide | |
| RU- 3a | hexammine ruthenium(III) sulfite | +0.10[a] |
| RU- 3b | hexammine ruthenium(II) sulfite | |
| RU- 4a | hexammine ruthenium(III) perchlorate | +0.10[a] |
| RU- 4b | hexammine ruthenium(II) perchlorate | |
| RU- 5a | hexammine ruthenium(III) nitrate | +0.10[a] |
| RU- 5b | hexammine ruthenium(II) nitrate | |
| RU- 6a | hexammine ruthenium(III) hexafluorophosphate | +0.10[a] |
| RU- 6b | hexammine ruthenium(II) hexafluorophosphate | |
| RU- 7a | hexammine ruthenium(III) thiocyanate | +0.10[a] |
| RU- 7b | hexammine ruthenium(II) thiocyanate | |
| RU- 8a | hexammine ruthenium(III) methylsulfonate | +0.10[a] |
| RU- 8b | hexammine ruthenium(II) methylsulfonate | |
| RU- 9a | tris(ethylenediamine) ruthenium-(III) bromide | +0.20 |
| RU- 9b | tris(ethylenediamine) ruthenium-(II) bromide | |
| RU-10a | tris(ethylenediamine) ruthenium-(III) sulfate | +0.20 |
| RU-10b | tris(ethylenediamine) ruthenium-(II) sulfate | |
| RU-11a | tris(ethylenediamine) ruthenium-(III) nitrate | +0.20 |
| RU-11b | tris(ethylenediamine) ruthenium-(II) nitrate | |
| RU-12a | tris(ethylenediamine) ruthenium-(III) tetrabromozincate | +0.20 |
| RU-12b | tris(ethylenediamine) ruthenium-(II) tetrabromozincate | |
| RU-13a | tris(ethylenediamine) ruthenium-(III) tetrafluoroborate | +0.20 |
| RU-13b | tris(ethylenediamine) ruthenium-(II) tetrafluoroborate | |
| RU-14a | tris(ethylenediamine) ruthenium-(III) thiocyanate | +0.20 |
| RU-14b | tris(ethylenediamine) ruthenium-(II) thiocyanate | |
| RU-15a | tris(ethylenediamine) ruthenium-(III) methylsulfonate | +0.20 |
| RU-15b | tris(ethylenediamine) ruthenium-(II) methylsulfonate | |
| RU-16a | tris(ethylenediamine) ruthenium-(III) tolylsulfonate | +0.20 |
| RU-16b | tris(ethylenediamine) ruthenium-(II) tolylsulfonate | |
| RU-17a | monochloropentammine ruthenium-(III) chloride | −0.042 |
| RU-17b | monochloropentammine ruthenium-(II) chloride | |
| RU-18a | monochloropentammine ruthenium-(III) nitrite | −0.042 |
| RU-18b | monochloropentammine ruthenium-(II) nitrite | |
| RU-19a | monochloropentammine ruthenium-(III) nitrate | −0.042 |
| RU-19b | monochloropentammine ruthenium-(II) nitrate | |
| RU-20a | monochloropentammine ruthenium-(III) tetrabromozincate | −0.042 |
| RU-20b | monochloropentammine ruthenium-(II) tetrabromozincate | |
| RU-21a | monochloropentammine ruthenium-(III) sulfate | −0.42 |
| RU-21b | monochloropentammine ruthenium-(II) sulfate | |
| RU-22a | monochloropentammine ruthenium-(III) perchlorate | −0.042 |
| RU-22b | monochloropentammine ruthenium-(II) perchloroate | |
| RU-23a | monochloropentammine ruthenium-(III) thiocyanate | −0.042 |
| RU-23b | monochloropentammine ruthenium-(II) thiocyanate | |
| RU-24a | monochloropentammine ruthenium-(III) dithionate | −0.042 |
| RU-24b | monochloropentammine ruthenium-(II) dithionate | |
| RU-25a | bromopentammine ruthenium(III) bromide | −0.03 |
| RU-25b | bromopentammine ruthenium(II) bromide | |
| RU-26a | bromopentammine ruthenium(III) sulfite | −0.03 |
| RU-26b | bromopentammine ruthenium(II) sulfite | |
| RU-27a | bromopentammine ruthenium(III) nitrite | −0.03 |
| RU-27b | bromopentammine ruthenium(II) nitrite | |
| RU-28a | bromopentammine ruthenium(III) tetrabromozincate | −0.03 |
| RU-28b | bromopentammine ruthenium(II) tetrabromozincate | |
| RU-28b | bromopentammine ruthenium(III) tetrafluoroborate | −0.03 |
| RU-29b | bromopentammine ruthenium(II) tetrafluoroborate | |
| RU-30a | bromopentammine ruthenium(III) hexafluorophosphate | −0.03 |
| RU-30b | bromopentammine ruthenium(II) hexafluorophosphate | |
| RU-31a | bromopentammine ruthenium(III) dithionate | −0.03 |
| RU-31b | bromopentammine ruthenium(II) dithionate | |
| RU-32a | bromopentammine ruthenium(III) | |

TABLE I-continued

| | Exemplary Cationic Ruthenium Complexes | Reduction Potentials (volts)for Ruthenium-(III)Complexes |
|---|---|---|
| | tolyl sulfonate | −0.03 |
| RU-32b | bromopentammine ruthenium(III) tolyl sulfonate | |
| RU-33a | diaquotetrammine ruthenium(III) chloride | +0.10 |
| RU-33b | diaquotetrammine ruthenium(II) chloride | |
| RU-34a | diaquotetrammine ruthenium(III) sulfite | +0.10 |
| RU-34b | diaquotetrammine ruthenium(II) sulfite | |
| RU-35a | diaquotetrammine ruthenium(III) sulfate | +0.10 |
| RU-35b | diaquotetrammine ruthenium(II) sulfate | |
| RU-36a | diaquotetrammine ruthenium(III) perchlorate | +0.10 |
| RU-36b | diaquotetrammine ruthenium(II) perchlorate | |
| RU-37a | diaquotetrammine ruthenium(III) nitrite | +0.10 |
| RU-37b | diaquotetrammine ruthenium(II) nitrite | |
| RU-38a | diaquotetrammine ruthenium(III) tetrafluoroborate | +0.10 |
| RU-38b | diaquotetrammine ruthenium(II) tetrafluoroborate | |
| RU-39a | diaquotetrammine ruthenium(III) methylsulfonate | +0.10 |
| RU-39b | diaquotetrammine ruthenium(II) methylsulfonate | |
| RU-40a | diaquotetrammine ruthenium(III) tolylsulfonate | +0.10 |
| RU-40b | diaquotetrammine ruthenium(II) tolylsulfonate | |
| RU-41a | pyridine pentammine ruthenium(III) sulfite | +0.30 |
| RU-41b | pyridine pentammine ruthenium(II) sulfite | |
| RU-42a | pyridine pentammine ruthenium(III) sulfate | +0.30 |
| RU-42b | pyridine pentammine ruthenium(II) sulfate | |
| RU-43a | pyridine pentammine ruthenium(III) hexafluorophosphate | +0.30 |
| RU-43b | pyridine pentammine ruthenium(II) hexafluorophosphate | |
| RU-44a | pyridine pentammine ruthenium(III) dithionate | +0.30 |
| RU-44b | pyridine pentammine ruthenium(II) dithionate | |
| RU-45a | pyridine pentammine ruthenium(III) methyl sulfonate | +0.30 |
| RU-45b | pyridine pentammine ruthenium(II) methyl sulfonate | |
| RU-46a | pyrazine pentammine ruthenium(III) bromide | +0.49 |
| RU-46b | pyrazine pentammine ruthenium(II) bromide | |
| RU-47a | pyrazine pentammine ruthenium(III) perchlorate | +0.49 |
| RU-47b | pyrazine pentammine ruthenium(II) perchlorate | |
| RU-48a | pyrazine pentammine ruthenium(III) tetrabromozincate | +0.49 |
| RU-48b | pyrazine pentammine ruthenium(II) tetrabromozincate | |
| RU-49a | pyrazine pentammine ruthenium(III) tetrafluoroborate | +0.49 |
| RU-49b | pyrazine pentammine ruthenium(II) tetrafluoroborate | |
| RU-50a | pyrazine pentammine ruthenium(III) thiocyanate | +0.49 |
| RU-50b | pyrazine pentammine ruthenium(II) thiocyanate | |
| RU-51a | pyrazine pentammine ruthenium(III) tolyl sulfonate | +0.49 |
| RU-51b | pyrazine pentammine ruthenium(II) tolyl sulfonate | |
| RU-52a | isonicotinamido pentammine ruthenium(III) chloride | +0.44 |
| RU-52b | isonicotinamido pentammine ruthenium(II) chloride | |
| RU-53a | isonicotinamido pentammine ruthenium(III) nitrite | +0.44 |
| RU-53b | isonicotinamido pentammine ruthenium(II) nitrite | |
| RU-54a | isonicotinamido pentammine ruthenium(III) nitrate | +0.44 |
| RU-54b | isonicotinamido pentammine ruthenium(II) nitrate | |
| RU-55a | isonicotinamido pentammine ruthenium(III) dithionate | +0.44 |
| RU-55b | isonicotinamido pentammine ruthenium(II) dithionate | |
| RU-56a | 4-(methylcarboxylato)pyridine pentammine ruthenium(III) bromide | +0.46 |
| RU-56b | 4-(methylcarboxylato)pyridine pentammine ruthenium(II) bromide | |
| RU-57a | 4-(methylcarboxylato)pyridine pentammine ruthenium(III) sulfite | +0.46 |
| RU-57b | 4-(methylcarboxylato)pyridine pentammine ruthenium(II) sulfite | |
| RU-58a | 4-(methylcarboxylato)pyridine pentammine ruthenium(III) sulfate | +0.46 |
| RU-58b | 4-(methylcarboxylato)pyridine pentammine ruthenium(II) sulfate | |
| RU-59a | 4-(methylcarboxylato)pyridine pentammine ruthenium(III) perchlorate | +0.46 |
| RU-59b | 4-(methylcarboxylato)pyridine pentammine ruthenium(II) perchlorate | |
| RU-60a | 4-(methylcarboxylato)pyridine pentammine ruthenium(III) nitrite | +0.46 |
| RU-60b | 4-(methylcarboxylato)pyridine pentammine ruthenium(II) nitrite | |
| RU-61a | 4-(methylcarboxylato)pyridine pentammine ruthenium(III) nitrate | +0.46 |
| RU-61b | 4-(methylcarboxylato)pyridine pentammine ruthenium(II) nitrate | |
| RU-62a | tris(2,2′-bipyridine) ruthenium-(III) chloride | +1.20 |
| RU-62b | tris(2,2′-bipyridine) ruthenium-(II) chloride | |
| RU-63a | tris(2,2′-bipyridine) ruthenium-(III) tetrabromozincate | +1.20 |
| RU-63b | tris(2,2′-bipyridine) ruthenium-(II) tetrabromozincate | |
| RU-64a | tris(2,2′-bipyridine) ruthenium-(III) hexafluorophosphate | +1.20 |
| RU-64b | tris(2,2′-bipyridine) ruthenium-(II) hexafluorophosphate | |
| RU-65a | tris(2,2′-bipyridine) ruthenium-(III) dithionate | +1.20 |
| RU-65b | tris(2,2′-bipyridine) ruthenium-(II) dithionate | |

[a]Meyer and Taube, "Electron-Transfer Reaction of Ruthenium Ammines", Inorganic Chemistry, Vol. 7, No. 11, November, 1968.

Since the ruthenium complexes employed in the practice of this invention are not consumed in use, very low concentrations are effective. It is generally unnecessary to employ the ruthenium complexes in concentrations greater than 0.1 mole per liter of the photographic silver halide developer. It is generally preferred to use the ruthenium complexes in concentrations of from $1 \times 10^{-5}$ to $1 \times 10^{-3}$ moles per liter, although any development accelerating amount of the ruthenium complexes can be employed.

It is contemplated to employ the ruthenium complexes in photographic silver halide developers in which each of the developing agents present exhibits in the absence of other developing agents and the ruthenium complex a substantial induction period—e.g., in excess of about 5 seconds. The induction periods of most common photographic silver halide developing agents have been measured and reported in the literaure. Alternately, the induction period for any given developing agent can be readily determined merely by formulating the developer with only that developing agent present and the ruthenium complex absent and observing the development properties of the resulting photographic developer. The method for measuring the induction period of a developing agent and the development rate in the continuation stage is described in a paper by R. G. Willis and R. B. Pontius, *Photographic Science and Engineering*, Vol. 14, p. 385 (1970). FIG. 1 on page 387 of that paper is an example of the type of plot from which these values are determined.

In addition to exhibiting substantial induction periods at least one of the developing agents present is chosen to exhibit a rate of reduction of ruthenium(III) which exceeds its rate of reduction of silver halide. The ruthenium(III) reduced is that which is either in the ruthenium complex initially or which is formed by the oxidation of the ruthenium(II) in the complex. If a developing agent, such as 1-phenyl-3-pyrazolidone, dihydroanhydropiperidinohexose reductone, or 4-amino-N-ethyl-N-($\beta$-methanesulfonamidoethyl)-m-toluidine sesquisulfate, which exhibits no observable induction period even in the absence of a ruthenium complex, is employed, no development acceleration can be observed through the incorporation of a ruthenium(III) complex even though the developing agent may more readily reduce the ruthenium(III) complex than silver halide. On the other hand, in observing the behavior of developing agents, e.g., p-aminophenol and p-phenylenediamine color developing agents, having induction periods ranging from 1 second to well in excess of 5 seconds, but which more readily reduce silver halide than ruthenium(III) complexes, I have not observed development acceleration to occur, except when such developing agents are employed in combination with other developing agents which also have substantial induction periods and which exhibit a greater reduction rate for the ruthenium(III) complex present than for silver halide.

One preferred class of developing agents are polyhydroxybenzenes. I have found pyrogallols, catechols and hydroquinones to be particularly useful developing agents in the practice of my invention. Exemplary preferred polyhydroxybenzene developing agents are set forth in Table II.

TABLE II

| Exemplary Polyhydroxybenzene Developing Agents | |
|---|---|
| DA- 1 | catechol |
| DA- 2 | gallic acid |
| DA- 3 | phloroglucinol |
| DA- 4 | pyrogallol |
| DA- 5 | hydroxyhydroquinone |
| DA- 6 | hydroquinone |
| DA- 7 | chlorohydroquinone |
| DA- 8 | bromohydroquinone |
| DA- 9 | isopropylhydroquinone |
| DA-10 | toluhydroquinone |
| DA-11 | methylhydroquinone |
| DA-12 | 2,3-dichlorohydroquinone |
| DA-13 | 2,5-dimethylhydroquinone |
| DA-14 | 2,3-dibromohydroquinone |
| DA-15 | 1,4-dihydroxy-2-acetophenone-2,5-dimethylhydroquinone |
| DA-16 | 2,5-diethylhydroquinone |
| DA-17 | 2,5-di-p-phenethylhydroquinone |
| DA-18 | 2,5-dibenzoylaminohydroquinone |
| DA-19 | 2,5-diacetaminohydroquinone |

Another preferred class of developing agents is comprised of hydroxylamine developing agents. Such developing agents are characterized by the hydroxy substituted nitrogen atom of the amine also being substituted with at least one organic aliphatic or aromatic radical. Such hydroxylamine developing agents include N-alkyl and N,N-dialkylhydroxylamines N-alkoxyalkyl and N,N-dialkoxyalkylhydroxylamines, N-arylhydroxylamines, N-alkarylhydroxylamines, etc. In each instance the alkyl moiety is preferably comprised of from 1 to 5 carbon atoms and the aryl moiety is preferably a phenyl moiety. Other hydroxylamine developing agents containing intralinear sulfo and intralinear cyclic or acyclic nitrogen atoms are disclosed in U.S. Pats. 3,287,124 and 3,287,125, each issued Nov. 22, 1966. Other hydroxylamine developing agents are disclosed in U.S. Pats. 2,857,274; 2,857,275 and 2,857,276, each issued Oct. 21, 1958; in British Patent 1,142,134, published Feb. 5, 1969, and in Belgium Patent 558,501, published July 15, 1957. The use of cyclic hydroxylamines, such as N-hydroxylmorpholine, is also contemplated.

Exemplary preferred hydroxylamine developing agents are set forth below in Table III.

TABLE III

| Exemplary Hydroxylamine Developing Agents | |
|---|---|
| DA-20 | dimethylhydroxylamine |
| DA-21 | diethylhydroxylamine |
| DA-22 | n-butylhydroxylamine |
| DA-23 | phenylhydroxylamine |
| DA-24 | o-tolylhydroxylamine |
| DA-25 | p-tolylhydroxylamine |
| DA-26 | o-xylylhydroxylamine |
| DA-27 | p-xylylhydroxylamine |
| DA-28 | N,N-di(ethoxyethyl)hydroxylamine |
| DA-29 | N,N-di(methoxyethyl)hydroxylamine |

Hydroxyurea developing agents constitute another preferred class of silver halide developing agents useful in the practice of this invention. Exemplary preferred hydroxyureas are represented by the formula:

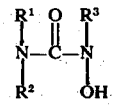

wherein $R^1$, $R^2$ and $R^3$ are hydrogen, alkyl, especially alkyl containing 1 to 4 carbon atoms, such as methyl, ethyl, propyl and butyl, or aryl, typically aryl containing 6 to 10 carbon atoms, such as phenyl, tolyl and xylyl. $R^1$, $R^2$ and/or $R^3$ can contain substituent groups which do not adversely affect developing activity of the described N-hydroxyurea silver halide developing agents. Such substituent groups include, for example, halogen or amino groups. Within the described class of N-hydroxyurea silver halide developing agents especially useful reducing agents are those wherein $R^1$ is hydrogen, alkyl containing 1 to 4 carbon atoms or aryl containing 6 to 10 carbon atoms, such as phenyl, tolyl or xylyl; $R^2$ is hydrogen, alkyl of 1 to 4 carbon atoms or aryl containing 6 to 10 carbon atoms such as phenyl, tolyl or xylyl; $R^3$ is hydrogen, alkyl containing 1 to 4 carbon atoms or phenyl, tolyl or xylyl. Particularly useful hydroxyurea developing agents are those of the formula

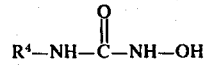

wherein $R^4$ is phenyl, p-methylphenyl, p-methoxyphenyl or p-chlorophenyl. Such developing agents are disclosed in Wilson et al., U.S. Ser. No. 252,036, filed May 10, 1972, commonly assigned. Exemplary preferred hydroxyurea developing agents are set forth below in Table IV.

TABLE IV

| Exemplary Hydroxyurea Developing Agents | |
|---|---|
| DA-30 | hydroxyurea |
| DA-31 | N'-phenyl-N-hydroxyurea |
| DA-32 | N'-(p-tolyl)-N-hydroxyurea |
| DA-33 | N'-(p-methoxyphenyl)-N-hydroxyurea |
| DA-34 | N'-(p-chlorophenyl)-N-hydroxyurea |
| DA-35 | N,N'-diphenyl-N-hydroxy |
| DA-36 | N'-(m-chlorophenyl)-N-hydroxyurea |
| DA-37 | N'-(p-nitrophenyl)-N-hydroxyurea |
| DA-38 | N',N'-diphenyl-N-hydroxyurea |
| DA-39 | N'-phenyl-N-methyl-N-hydroxyurea |
| DA-40 | N'-ethyl-N-hydroxyurea |

Another preferred class of developing agents useful in the practice of this invention are pyrimidine developing agents. Particularly preferred pyrimidines are those which in their enol form have adjacent amino and/or hydroxyl ring substituents. Both the amino substituents and the remaining ring positions can be either substituted or unsubstituted, and the substituents, if any, at the 2 and 3 ring positions can, optionally, form a fused ring system. Amino and ring substituents such as alkyl, alkoxy, alkoxyalkyl, alkenyl, aryl, aryloxy, alkaryl, aralkyl, and the like are contemplated. In the preferred form the aliphatic substituent moieties each have 6 or fewer carbon atoms while the aryl substituents are preferably phenyl substituents, but in the 2 and 3 ring positions can be those which form fused rings with the pyrimidine ring. Pyrimidine developing agents of this type are disclosed by Henn and Carpenter in *Photographic Science Engineering, Vol.* 3, at page 135 (1959).

Exemplary preferred pyrimidine developing agents are those set forth below in Table V.

TABLE V

| Exemplary Preferred Pyrimidine Developing Agents | |
|---|---|
| DA-41 | 2-isopropyl-4,5,6-trihydroxypyrimidine |
| DA-42 | 4-amino-5,6-dihydroxy-2-methylpyrimidine |
| DA-43 | 1-methyl-2-propyl-4,5,6-trihydroxy-pyrimidine |
| DA-44 | 5-aminobarbituric acid (uramil) |
| DA-45 | 2,5-diamino-4,6-dihydroxypyrimidine |
| DA-46 | 2,4,5-triaminopyrimidine |
| DA-47 | 5-amino-2,4-dihydroxypyrimidine (5-amino-uracil) |
| DA-48 | 5,6-diamino-2,4-dihydroxypyrimidine (5,6-diaminouracil) |
| DA-49 | 5-amino-4,6-dihydroxypyrimidine |
| DA-50 | 6-methyl-2,4,5-trihydroxypyrimidine |
| DA-51 | 2-amino-4,5-dihydroxypyrimidine |

The use of ascorbic acid developing agents is also contemplated. Such developing agents include ascorbic acid, ascorbic acid ketals, and derivatives such as iminoascorbic acids and sugar analogs thereof of the type disclosed by Reynolds in U.S. Pat. 2,688,548, issued Sept. 7, 1954. Exemplary preferred ascorbic acid developing agents of this type are set forth below in Table VI.

TABLE VI

| Exemplary Preferred Ascorbic Acid Developing Agents | |
|---|---|
| DA-52 | ascorbic acid |
| DA-53 | imino-l-erythroascorbic acid |
| DA-54 | imino-l-ascorbic acid |
| DA-55 | imino-d-glucoascorbic acid |
| DA-56 | imino-6-desoxy-l-ascorbic acid |
| DA-57 | imino-l-rhamnoascorbic acid |
| DA-58 | imino-l-fucoascorbic acid |
| DA-59 | imino-d-glucoheptoascorbic acid |
| DA-60 | imino-sorboascorbic acid |
| DA-61 | imino-ω-lactoascorbic acid |
| DA-62 | imino-maltoascorbic acid |
| DA-63 | imino-l-araboascorbic acid |
| DA-64 | imino-d-glucoascorbic acid |
| DA-65 | imino-d-galatoascorbic acid |
| DA-66 | imino-l-glucoascorbic acid |
| DA-67 | imino-l-alloascorbic acid |

The photographic silver halide developers of my invention employ the developing agents singly or in combination in concentrations of from 0.01 molar to saturation, preferably in concentrations of from 0.01 to 0.5 molar. Except for the inclusion of ruthenium complexes and the selection of the developing agents, the photographic developers are otherwise of conventional composition. They typically include water as a solvent and are rendered basic by the inclusion of a suitable basic material. Typical photographic developers useful in the practice of this invention exhibit a pH in the range from about 9 to about 13. Typically one or a combination of alkali metal hydroxides and salts, such as sodium or potassium hydroxide, carbonate, bicarbonate, phosphate, silicate or the like, are employed to maintain the desired degree of basicity. To reduce oxidation of the developing agents present stabilizers, such as alkali metal and amine sulfites, are typically incorporated in a concentration of from 0.001 to 10 molar, as is well understood in the art.

Other conventional photographic silver halide developer addenda can, of course, be incorporated to produce known effects. Where a hydroquinone is employed as the developing agent and it is desired to develop photographic films of high contrast, such as those employed in the graphic arts—i.e., so called lith-type films, it is preferred to incorporate into the developer a carbonyl bisulfite-amine condensation product and at least about 0.075 mole of free amine per liter of developer composition, as taught by Masseth U.S. Pat. 3,573,914, issued Apr. 6, 1971. Such addenda stabilize the developer and eliminate drag streaks and dot distortions typically associated with machine processing.

The carbonyl bisulfite-amine condensation products are preferably formaldehyde bisulfite-amine condensation products such as sodium-2-hydroxyethylaminomethane sulfonate,
sodium-2-hydroxypropylaminomethane sulfonate,
sodium-1,1-dimethyl-2-hydroxylaminomethane sulfonate,
sodium-1,1-bis(hydroxymethyl)ethylaminomethane sulfonate,
sodium-tris(hydroxymethyl)methylaminomethane sulfonate,
sodium-3-hydroxypropylaminomethane sulfonate,
sodium-bis(2-hydroxyethyl)aminomethane sulfonate,
sodium-N,N-bis(2[1-hydroxy]propyl aminomethane sulfonate, sodium-N-isopropyl-N-(2-hydroxyethyl)-aminoethane sulfonate,
sodium-N-ethyl-N-(2-hydroxyethyl)-aminomethane sulfonate, and
sodium-N-methyl-N-(2-hydroxyethyl)-aminomethane sulfonate.

The carbonyl bisulfite-amine condensation products can be used alone or in any combination and can be employed in any combination which is effective to provide a low level of sulfite ion for the developer composition. A suitable concentration for the carbonyl bisulfite-amine condensation product is from about 0.1 to about 1.0 mole per liter of liquid developer composition and is preferably from about 0.25 to about 0.50 mole per liter of liquid developer composition.

The carbonyl bisulfite-amine condensation product can be added to the developer composition as a separate compound or formed in situ. Methods for preparing these compounds are disclosed, for example, in U.S. Pat. 2,388,816 of Bean issued Nov. 13, 1945. It is meant to include within the definition of carbonyl bisulfite-amine condensation product either the compound itself or the individual components which form the compound in situ.

The free or uncombined amine compounds which can be employed include primary and secondary amines such as 2-aminoethanol,
1-amino-2-propanol,
2-amino-
2-amino-2-methyl-1,3-propanediol,
2-amino-2(hydroxymethyl)-1,3-propanediol,
3-amino-1-propanol,
2,2'-iminodiethanol,
di-iso-propanolamine,
2-isopropylaminoethanol,
2-ethylaminoethanol,
2-methylaminoethanol, etc.

These amines can be used alone or in any combination and should be employed in a concentration of at least about 0.075 mole per liter of developer composition. Concentrations of the amine below this minimum value do not provide a stable developer. A suitable range of concentrations for the amine compound is from about 0.075 to about 3.0 moles per liter of developer composition and is preferably from about 0.20 to about 9.0 mole per liter of developer composition. The free amine present in the developer composition can be the same amine used to prepare the carbonyl bisulfite-amine condensation product or it can be a different amine.

While I have disclosed my invention in terms of the basic aqueous photographic developers used to develop silver halide photographic elements, it is apparent that my invention can take the form of compositions useful in forming these photographic developers. It is generally well within the capabilities of the photographic processor to add to water the ingredients necessary to constitute a basic aqueous photographic developer, once directions have been supplied. It is accordingly common practice to package and sell compositions which, when added to water or aqueous solutions alone or in combination with other materials, will form a useful photographic developer.

In one form of my invention I contemplate a composition consisting essentially of the developing agents and the ruthenium complexes described above as useful in the practice of my invention. Since the ingredients used to form the photographic developers of my invention are generally compatible when stored together in the absence of a solvent, I prefer in most instances to form a composition which includes in addition to the ruthenium complexes and the developing agents of my invention all other ingredients which, when added to water, form a photographic developer according to my invention. Where one or more of these ingredients prove chemically incompatible or otherwise disadvantageous to package with the other ingredients, they can, of course, be packaged separately.

In a preferred composition for forming a photographic developer the ruthenium complexes and developing agents can be present in the relative proportions desired in the photographic developer—e.g., from 0.2 to $1 \times 10^{-5}$ moles of ruthenium complex per mole of developing agent. These proportions are not required, however, since additional developing agent or ruthenium complex can be supplied to the photographic developer from a separate source. In like manner remaining ingredients for the photographic developer can be present in various proportions, preferably in the proportion desired in the photographic developer.

My invention may be further appreciated by reference to the following specific examples.

Examples 1 through 11 — Acceleration of Induction Periods

A number of representative developing agents were chosen and separately employed to form photographic silver halide developer compositions consisting essentially of 200 ml of water, 20 grams of sodium sulfite, 10 g of sodium carbonate, sufficient acetic acid to reduce the pH of the developer to the desired value and a 0.05 molar concentration of the developing agent. Each developer was then divided into two aliquot portions and a $5 \times 10^{-4}$ molar concentration of hexammine ruthenium (III) chloride (RU-1*a*) was added to one aliquot portion. Induction periods were then determined employing the procedures of Willis and Pontius, cited above. A black-and-white photographic motion picture print film bearing a fine grain silver chlorobromide emulsion coating was exposed and developed. The results are summarized in Table VII below.

TABLE VII

Comparative Induction Periods

| Example No. | Developing Agents | pH | Induction Period (seconds) w/o Ru(III) | w Ru(III) |
|---|---|---|---|---|
| Control | Elon*(N-methyl-p-aminophenol sulfate) | 10.0 | 1.0 | 1.0 |
| Control | p-aminophenol | 10.0 | 1.5 | 1.5 |
| Control | 2,4-diaminophenol dihydrochloride | 7.2 | 1.5 | 1.5 |
| Control | hydroquinone-Elon (equal pts. by wt.) | 9.5 | 11.0 | 9.0 |
| Control | hydroquinone-Elon (4:2 pts. by wt.) | 9.0 | 31.0 | 35.0 |
| Control | 1-phenyl-3-pyrazolidone | 12.0 | ~0.0 | ~0.0 |
| Control | dihydroanhydropiperidinohexose reductone | 11.6 | ~0.0 | ~0.0 |
| Control | N,N-diethyl-p-phenylenediamine | 12.0 | 2.0 | 7.0 |
| Control | 4-amino-N-ethyl-N-(β-methanesulfonamido | | | |

TABLE VII-continued

| Example No. | Developing Agents | pH | Induction Period (seconds) w/o Ru(III) | w Ru(III) |
|---|---|---|---|---|
| | Comparative Induction Periods | | | |
| | ethyl)-m-toluidine sesquisulfate | 11.7 | ~0.0 | ~0.0 |
| Control | 4-amino-3-methyl-N-ethyl-N-β-methoxy-ethylaniline p-tolylsulfonate | 10.5 | 10.0 | 10.0 |
| 1 | ascorbic acid (DA-52) | 10.0 | 90.0 | 6.0 |
| 2 | hydroquinone (DA-6) | 10.0 | 30.0 | 5.0 |
| 3 | methylhydroquinone (DA-11) | 10.0 | 130.0 | 11.0 |
| 4 | pyrogallol (DA-4) | 10.0 | 9.0 | 1.0 |
| 5 | 2,5-dichlorohydroquinone | 10.0 | 10.0 | 1.0 |
| 6 | 2-isopropyl-4,5,6-trihydroxypyrimidine (DA-41) | 11.8 | 22.0 | ~0.0 |
| 7 | 4-amino-5,6-dihydroxy-2-methylpyrimidine (DA-42) | 11.0 | 11.0 | ~0.0 |
| 8 | 1-methyl-2-propyl-4,5,6-trihydroxy-pyrimidine (DA-43) | 11.5 | 10.0 | ~0.0 |
| 9 | N-(p-methoxyphenyl)-N'-hydroxyurea (DA-33) | 12.0 | 72.0 | 8.0 |
| 10 | N-(p-chlorophenyl)-N'-hydroxyurea (DA-34) | 12.3 | 55.0 | 1.0 |
| 11 | diethylhydroxylamine (DA-21) | 12.1 | 117.0 | 10.0 |

*Trademark of Eastman Kodak Company

In reviewing the results of Table VII it is apparent that all of the photographic silver halide developer compositions incorporating the ruthenium complex and employing developing agents according to my invention exhibited marked reductions in induction periods attributable to the incorporation of the ruthenium (III) complex. Only one of the photographic developers incorporating a developing agent (Elon) having an induction period of less than 5 seconds exhibited any reduction in the induction period attributable to the incorporation of the ruthenium (III) complex. However, the reduction of the induction period was quite small as compared to the induction period reductions exhibited by the photographic developers of my invention. Only one of the developing agents (4-amino-3-methyl-N-ethyl-N-β-methoxyethylaniline p-tolylsulfonate) exhibiting an induction period of more than 5 seconds in the absence of the ruthenium (III) complex failed to show marked reduction of the induction period as a result of incorporating the ruthenium (III) complex. This lack of induction period reduction was attributed to the fact that this particular developing agent, like the p-aminophenols and p-phenylenediamines in general, more readily reduces silver halide than the ruthenium (III) complex.

Examples 12 through 15 — Acceleration on Continuation Stage

Employing the procedures of Willis and Pontius, cited above, the acceleration of the continuation stage was measured for some of the developers of Examples 1 through 11. The acceleration of the continuation stage is reported as the ratio of the development rate with the ruthenium (III) complex divided by the development rate without the ruthenium (III) complex. Similarly, induction period accelerations reported in subsequent examples represent a ratio of the induction period without the ruthenium complex divided by the induction period with the ruthenium complex present. Thus acceleration values are above 1.0 when development was accelerated and below 1.0 when development was retarded. The results are summarized below in Table VIII.

Table VIII

| Example No. | Developing Agent | Acceleration of Continuation Stage |
|---|---|---|
| Control | Elon | 1.0 |

Table VIII-continued

| Example No. | Developing Agent | Acceleration of Continuation Stage |
|---|---|---|
| Control | p-aminophenol | 1.0 |
| Control | 4-amino-3-methyl-N-ethyl-N-β-methoxyethyl aniline | 0.86 |
| 12 | pyrogallol (DA-4) | 2.4 |
| 13 | hydroquinone (DA-6) | 2.3 |
| 14 | ascorbic acid (DA-52) | 2.9 |
| 15 | methylhydroquinone (DA-11) | 8.9 |

Examples 16 through 18 — Comparison of Development and Ruthenium Reduction Rates A 0.1 molar solution of sodium carbonate in water and a 3.0 molar sodium bicarbonate aqueous solution were mixed to obtain a pH of 10. Hexammine ruthenium(III) chloride was then added to the solution to produce a net optical density upon standing of 0.1. At the same time a developing agent and sodium sulfite were each added to water to a concentration of 0.01 molar to form a second solution. The solutions were then mixed together and the rate of density loss was immediately measured spectrophotometrically. From this measurement the rate of ruthenium(III) complex reduction to the corresponding colorless ruthenium(II) complex was calculated. The rates of silver halide development exhibited by the developing agents in the absence of the ruthenium(III) complex were determined using the photographic elements and developers lacking a ruthenium complex of Examples 1 through 11. Rates are reported in units of liter $mole^{-1}$ $second^{-1}$. The results are summarized below in Table IX.

TABLE IX

| Example No. | Developing Agent | Reduction Rates Silver Halide | Ru(III) |
|---|---|---|---|
| | Exemplary Comparative Reduction Rates | | |
| 16 | hydroquinone (DA-6) | 0.16 | 1.1 |
| 17 | methylhydroquinone (DA-11) | 0.046 | 2.7 |
| Control | Elon | 0.46 | 0.27 |
| Control | p-aminophenol | 0.18 | 0.11 |
| 18 | ascorbic acid (DA-52) | 0.05 | 0.8 |

Table IX illustrates that the developing agents, such as hydroquinone and ascorbic acid developing agents, useful in the practice of my invention, exhibit reduction rates for ruthenium(III) which are markedly greater than their reduction rates for silver halide. At the same time, the aminophenol developing agents exhibit rates of reduction of silver halide which are somewhat greater than their rates of reduction of ruthenium(III). This is in agreement with the observation that the induction periods of p-aminophenols are not reduced through the use of ruthenium(III) complexes as development accelerators.

The examples which follow show the effectiveness of additional ruthenium(II) and (III) cationic complexes as development accelerators.

Example 19

The procedures of Examples 1 through 15 were repeated using hydroquinone (DA-6) as a developing agent and tris(2,2'-bipyridine) ruthenium(III) chloride (RU-62a) as a development accelerator. An induction period acceleration of 4 and a continuation stage acceleration of 2 was observed. Because of the potential relationships of the silver chlorobromide and the development acceleraor it is not believed that the development accelerator was functioning in this situation to form a redox couple between the developing agent and silver halide.

Example 20

The procedure of Example 19 was repeated, but with the substitution of tris(ethylenediamine)ruthenium(II) tetrabromozincate (RU-12thiocyanatopentammine An induction period acceleration of 60 and a continuation stage acceleration of 1.25 was observed.

Examples 21 through 23

The procedure of Examples 1 through 11 was repeated, but with the substitution of thiocyaanatopentammine ruthenium(III) methylsulfonate for the hexammine ruthenium(III) chloride. The results are summarized below in Table X.

TABLE X

| Example No. | Developing Agent | Induction Period Acceleration |
|---|---|---|
| Control | p-aminophenol | 0.86 |
| Control | Elon | 1.0 |
| 21 | hydroquinone | 29.0 |
| 22 | methylhydroquinone | 8.5 |
| 23 | ascorbic acid | 9.8 |

The invention has been described with particular reference to preferred embodiments thereof but it will be understood that variations and modifications can be effected within the spirit and scope of the invention.

I claim:

1. A composition useful in developing silver halide photographic elements comprising at least one silver halide developing agent and a development accelerating amount of at least one ruthenium(III) or (II) cationic complex including at least four ligands chosen from the class consisting of ammine or amine ligands, each said developing agent exhibiting in the absence of other silver halide developing agents and said ruthenium complex a silver halide development induction period in excess of 5 seconds and at least one said developing agent exhibiting a rate of reduction of ruthenium(III) in said ruthenium(III) cationic complex, or produced by the oxidation of said ruthenium(II) cationic complex, which exceeds its rate of reduction of silver halide.

2. A composition according to claim 1, in which said ruthenium complex includes at least four ammine ligands.

3. A composition according to claim 1, in which said ruthenium complex is a hexammine ruthenium(II) or hexammine ruthenium(III) complex.

4. A composition according to claim 1, in which said ruthenium complex includes at least four amine ligands.

5. A composition according to claim 4, in which said amine ligands are alkylene diamine ligands in which said alkylene group has from 1 to 6 carbon atoms.

6. A composition according to claim 5, in which said ruthenium complex is a tris(ethylenediamine)ruthenium(II) or tris(ethylenediamine)ruthenium(III) complex.

7. A composition according to claim 4 in which said amine ligands are pyridine ligands.

8. A composition according to claim 7 in which said ruthenium complex is a tris(2,2'-bipyridine)ruthenium(II) or tris(2,2'-bipyridine)ruthenium(III) complex.

9. A composition according to claim 1, in which said ruthenium(III) complex exhibits a reduction potential which is no less positive than the oxidation potential of said developing agent.

10. A composition according to claim 9 in which said ruthenium(III) complex exhibits a reduction potential which is between the oxidation potential of the developing agent and the reduction potential of silver halide.

11. A composition according to claim 1, in which said developing agent is chosen from the group consisting of polyhydroxybenzene, ascrobic acid, hydroxylamine, hydroxyurea and pyrimidine developing agents as well as mixtures thereof.

12. A basic aqueous photographic developer containing a development accelerator and as the sole developing agent or agents one or more developing agents chosen from the class consisting of polyhydroxybenzene, ascorbic acid, hydroxylamine, hydroxyurea and pyrimidine developing agents, wherein the improvement comprises from $1 \times 10^5$ to 0.1 mole per liter of developer of at least one ruthenium(II) or ruthenium(III) complex development accelerator including at least four ligands chosen from the class consisting of ammine or amine ligands, the reduction potential of said ruthenium(III) complex or the ruthenium(III) complex produced by oxidation of said ruthenium(II) complex more positive when the oxidation potential of at least one of said developing agents.

13. A basic photographic developer according to claim 12 comprised of the further improvement in which a hydroquinone polyhydroxybenzene developing agent chosen from said class of developing agents is present.

14. A basic photographic developer according to claim 13 comprised of the further improvement in which said hydroquinone includes at least one halogen or alkyl substituent, said alkyl substituent having from 1 to 6 carbon atoms.

15. A basic photographic developer according to claim 12 comprised of the further improvement in which a pyrogallol polyhydroxybenzene developing agent chosen from said class of developing agents is present.

16. A basic photographic developer according to claim 12 comprised of the further improvement in which a catechol polyhydroxybenzene developing agent chosen from said class of developing agents is present.

17. A basic photographic developer according to claim 12 comprised of the further improvement in which a pyrimidine developing agent is present having in the enol form adjacent ring substituents chosen from the class consisting of amino and hydroxyl substituents.

18. A basic photographic developer according to claim 12 comprised of the further improvement in which said ruthenium complex includes at least four ammine ligands.

19. A basic photographic developer according to claim 18 comprised of the further improvement in which said ruthenium complex is a hexammine ruthenium(II) or hexammine ruthenium(III) complex.

20. A basic aqueous photographic developer containing a development accelerator and hydroquinone as the sole developing agent, wherein the improvement comprises from $1 \times 10^{-5}$ to 0.1 mole per liter of developer of a hexammine ruthenium(II) or hexammine ruthenium(III) complex.

21. A method of accelerating the development of an imagewise exposed silver halide photographic element in a developer composition containing at least one silver halide developing agent, which method comprises incorporating in the developer composition a developement accelerating amount of at least one ruthenium(III) or (II) cationic complex including at least four ligands chosed from the class consistng of ammine or amine ligands, each developing agent exhibiting in the absence of other silver halide developing agents and the ruthenium cationic complex an induction period in excess of 5 seconds and at least one developing agent in the developer composition exhibiting a rate of reduction of ruthenium(III) in the ruthenium(III) cationic complex, or produced by the oxidation of the ruthenium(II) cationic complex, which exceeds its rate of reduction of silver halide, and bringing the developer composition into contact with the imagewise exposed photographic element.

22. A method of accelerating the development of an imagewise exposed silver halide photographic element in a developer composition containing as the sole developing agent or agents one or more developing agents chosen from the class consisting of polyhydroxybenzene, ascorbic acid, hydroxylamine, hydroxyurea and pyrimidine developing agents, which method comprises incorporating in the developer composition from $1 \times 10^{-5}$ to 0.1 mole per liter of developer of at least one ruthenium(II) or ruthenium(III) complex including at least four ligands chosen from the class consisting of ammine or amine ligands, the reduction potential of the ruthenium(III) complex or the ruthenium(III) complex produced by oxidation of the ruthenium(II) complex being more positive than the oxidation potential of at least one of the developing agents, and bringing the developer composition into contact with the imagewise exposed photographic element.

23. A method according to claim 22 including the step of incorporating hexammine ruthenium(II) or hexammine ruthenium(III) complex.

24. A method of accelerating the development of an imagewise exposed silver halide photographic element in a developer composition containing as the sole silver halide developing agent a hydroquinone, which method comprises incorporating in the developer composition from $1 \times 10^{-5}$ to 0.1 mole per liter of developer of a hexammine ruthenium(II) or hexammine ruthenium(III) complex and bringing the developer composition into contact with the imagewise exposed photographic element.

* * * * *